US006953314B2

(12) United States Patent
Magagna

(10) Patent No.: US 6,953,314 B2
(45) Date of Patent: Oct. 11, 2005

(54) FAUCET CLAMP

(76) Inventor: Timothy Magagna, 845 Barton #106, Pocatello, ID (US) 83204

( * ) Notice: Subject to any disclaimer, the term of this patent is extended or adjusted under 35 U.S.C. 154(b) by 0 days.

(21) Appl. No.: 10/417,292

(22) Filed: Apr. 16, 2003

(65) Prior Publication Data

US 2004/0208727 A1 Oct. 21, 2004

(51) Int. Cl.[7] ..... F16B 37/08

(52) U.S. Cl. ..... 411/433; 411/540; 411/900; 411/301

(58) Field of Search ..... 411/433, 437, 411/539, 540, 301, DIG. 1, 900, 901

(56) References Cited

U.S. PATENT DOCUMENTS

| | | | | | |
|---|---|---|---|---|---|
| 368,467 | A | | 8/1887 | Fouts | |
| 904,595 | A | | 11/1908 | Barmore | |
| 1,058,223 | A | * | 4/1913 | Dosch | 269/176 |
| 1,547,314 | A | | 7/1925 | Frankel | |
| 1,589,455 | A | * | 6/1926 | Barnum | 411/540 |
| 2,118,361 | A | * | 5/1938 | Schaeffer, Jr. | 411/433 |
| 2,531,003 | A | | 11/1950 | Slaker | |
| RE23,472 | E | | 3/1952 | Kindlund et al. | |
| 2,847,933 | A | | 8/1958 | Pate | |
| 2,931,264 | A | * | 4/1960 | Dallman | 411/366.1 |
| 3,030,681 | A | | 4/1962 | Phillips | |
| 3,060,637 | A | | 10/1962 | Fumeaux | |
| 3,802,437 | A | | 4/1974 | Kees, Jr. | |
| 3,807,885 | A | * | 4/1974 | Coski | 403/344 |
| 3,999,259 | A | | 12/1976 | Paajanen | |
| 4,037,859 | A | | 7/1977 | Clements | |
| 4,281,857 | A | * | 8/1981 | Randall | 285/34 |
| 4,424,405 | A | * | 1/1984 | Nattel | 174/53 |
| 4,502,165 | A | * | 3/1985 | Szemeredi et al. | 4/695 |
| 4,592,576 | A | | 6/1986 | Proctor et al. | |
| 5,199,675 | A | * | 4/1993 | DeGuchi | 248/62 |
| 5,489,075 | A | | 2/1996 | Ible | |
| 5,625,931 | A | | 5/1997 | Visser et al. | |
| 5,829,107 | A | | 11/1998 | Wimmenauer et al. | |
| 5,876,026 | A | | 3/1999 | Chen | |
| 6,170,858 | B1 | * | 1/2001 | Berger | 280/728.2 |
| 6,185,795 | B1 | | 2/2001 | Shui-Shang | |

* cited by examiner

*Primary Examiner*—Flemming Saether
(74) *Attorney, Agent, or Firm*—Pierce Atwood; Kevin M. Farrell; Ryan B. Kennedy

(57) ABSTRACT

A faucet clamp for retaining a faucet to a sink has first and second jaws that are pivoted together by a hinge. The jaws have internal clamping surfaces which include a thread-engaging surface, for example a compliant liner. The thread-engaging surface engages the threads of a faucet pipe extending from the faucet base and clamps the faucet to the sink. The jaws of the faucet clamp pivot to an open position for installation or removal over the faucet pipe.

15 Claims, 4 Drawing Sheets

FAUCET CLAMP

BACKGROUND OF THE INVENTION

This invention relates generally to plumbing fixtures and more particularly to a clamp for retaining a faucet.

Water faucets typically include one or more faucet pipes carrying water flow therein. These faucet pipes are externally threaded and prior art faucets are typically mechanically secured by means of threaded fasteners that are threaded onto the faucet pipes to clamp the faucet to the sink. This type of faucet installation can be very difficult and time consuming because of the need to work in a restricted area, such as underneath a countertop or cabinet, where there is little room for an installer's hands or tools. Furthermore, removing an old faucet can be difficult and time consuming because of the presence of corrosion or hard water deposits which hinder removal of the threaded fasteners.

Accordingly, there is a need for a faucet clamp which may be easily installed and removed.

BRIEF SUMMARY OF THE INVENTION

The above-mentioned need is met by the present invention, which provides a faucet clamp for retaining a faucet to a sink. The faucet clamp has first and second jaws that are pivoted together by a hinge. The jaws have internal clamping surfaces which include a thread-engaging surface, for example a compliant liner. The thread-engaging surfaces engage the threads of a faucet pipe extending from the faucet base and clamps the faucet to the sink. The jaws of the faucet clamp pivot to an open position for installation or removal over the faucet pipe.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
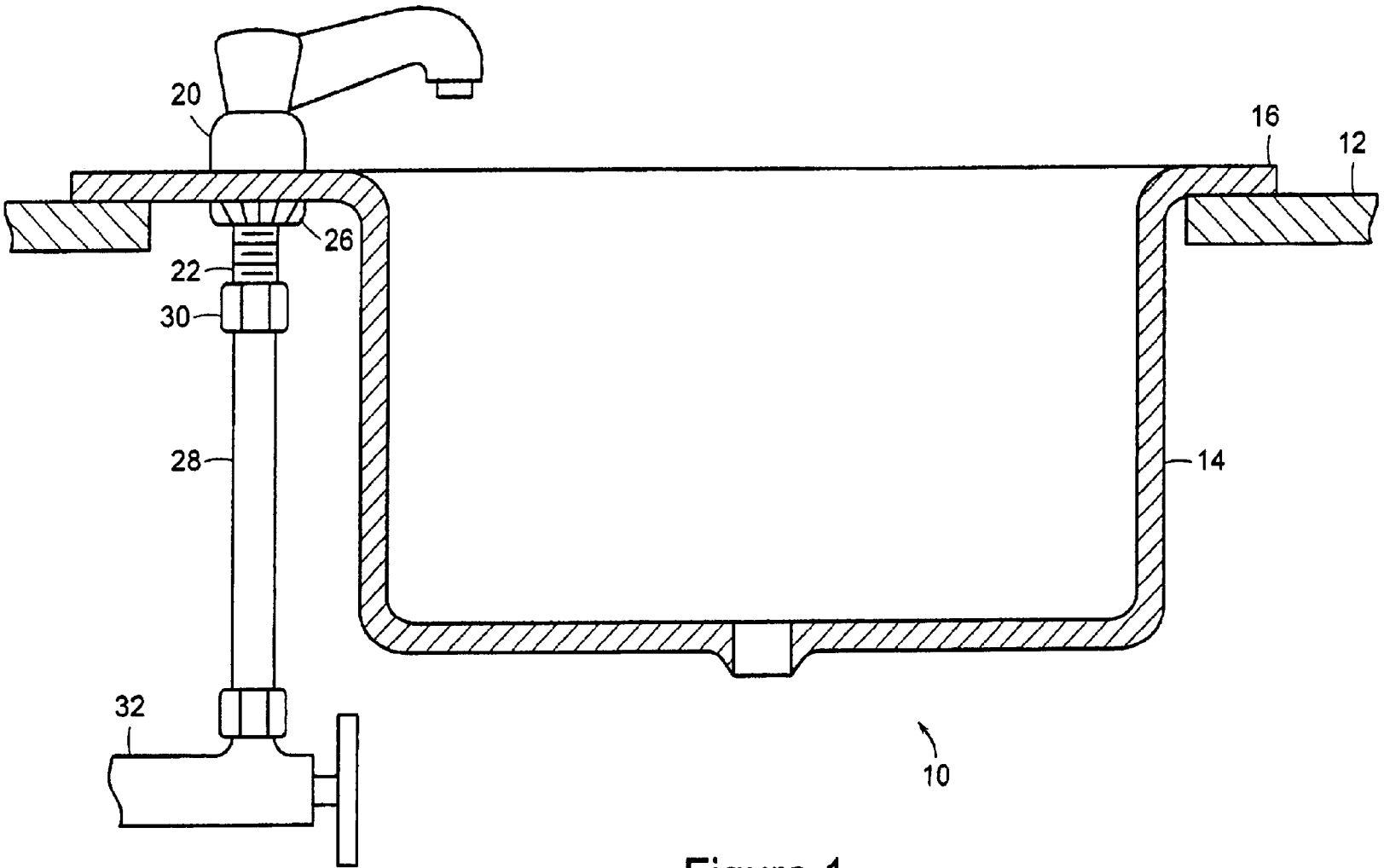
FIG. 1 shows a side cross-sectional view of a prior art sink and faucet installation.
Figure 2:
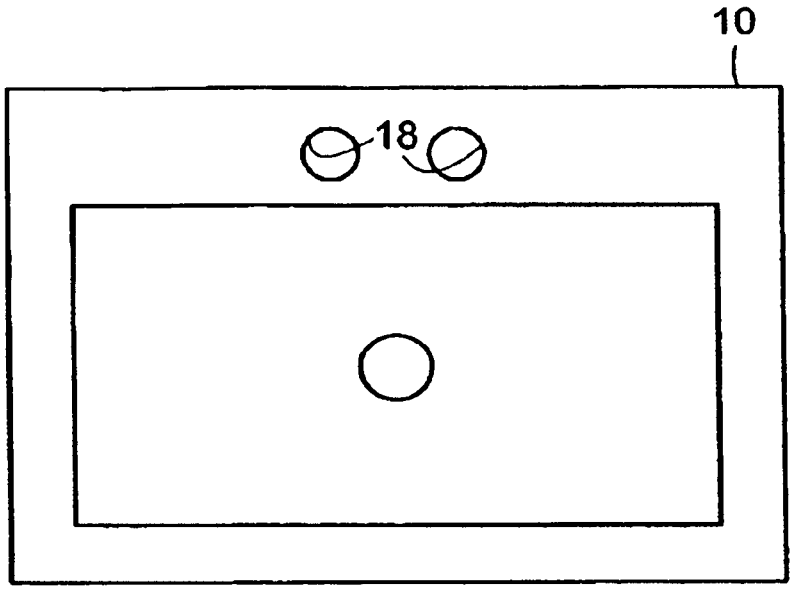
FIG. 2 shows a top view of the sink depicted in FIG. 1.
Figure 3:
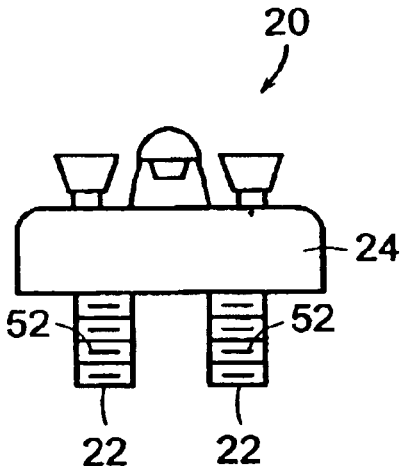
FIG. 3 shows a front view of a typical faucet.

Referring to the drawings wherein identical reference numerals denote the same elements throughout the various views, FIGS. 1, 2, and 3 show a view of a typical prior art faucet and sink installation. A sink 10 is placed in an opening in a countertop 12 and is usually secured thereto, for example with a plurality of clamps (not shown). The sink 10 may also be integrally formed with the countertop. The sink 10 includes a bowl 14 and a flange 16. One or more faucet mounting holes 18 are formed through the flange 16 (see FIG. 2).

A faucet 20 (see FIG. 3) includes a pair of protruding, externally threaded faucet pipes 22, one each for the hot and cold water supplies. The faucet pipes 22 may be of metal or plastic and are either integrally formed with or attached to the base 24 of the faucet 20. The faucet pipes 22 typically extend about 10 cm to 15 cm (4 to 6 in.) from the bottom surface of the faucet 20. To install the faucet 20, the faucet pipes 22 are placed through the faucet mounting holes 18 and then an internally threaded retainer nut 26 is screwed onto each faucet pipe 22 and tightened against the bottom surface of the sink flange 16 to clamp the faucet 20 into place. Subsequently, a thread sealant such as a tape comprising polytetrafluoroethylene (PTFE) is placed on the exposed threads of the faucet pipes 22. This procedure is commonly referred to as "taping" the threads. After taping, fill pipes 28 are connected to the faucet pipes 22 with threaded fittings 30. The opposite ends of the fill pipes 28 are connected to fill valves 32 which control the flow of hot and cold water.

The steps of taping and connecting the fill pipes 28 described above are time consuming and difficult because the installer must usually work inside a cabinet or under a sink which forces the installer to reach overhead in an awkward position amongst many obstacles. The problem may be especially exacerbated in cases where the sink 10 is relatively deep as shown in FIG. 1, because there is very little lateral room around the area where the faucet pipes 22 extend below the sink flange. It is also possible to tape the faucet pipes 22 and connect the fill pipes 28 to the faucet pipes 22 before the sink 10 is installed, and then to connect the free ends of the fill pipes 28 to the fill valves 32. However, this does not address the problem of removing the faucet 20 when replacement is desired. Because of corrosion or hard water deposits, and the same awkward position described above, it is often very difficult to remove the retainer nuts 26. Although it is possible to disconnect the fill pipes 28 from the fill valves 32 and then remove the sink 10, faucet 20, and fill pipes 28 as an assembly, this would entail disconnecting numerous clamps and breaking the seal between the sink 10 and the countertop 12, which is time consuming and undesirable.

Figure 5:
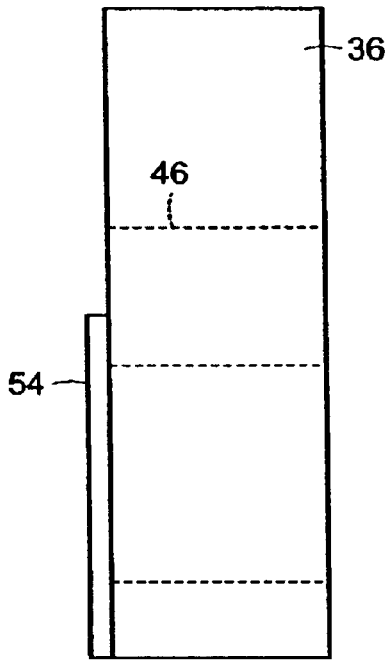
FIG. 5 is a side view of the faucet clamp of FIG. 4.
Figure 4:
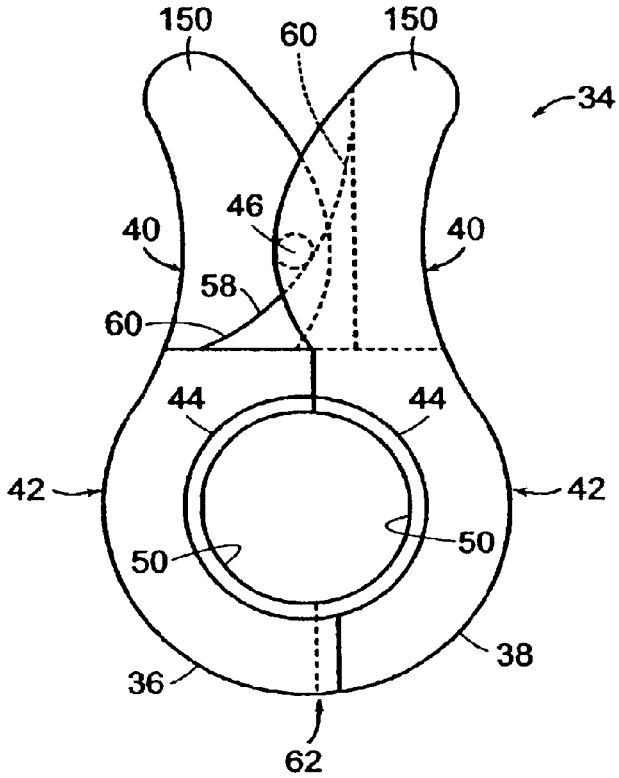
FIG. 4 is a top view of a first embodiment of a faucet clamp constructed in accordance with the present invention.
Figure 6:
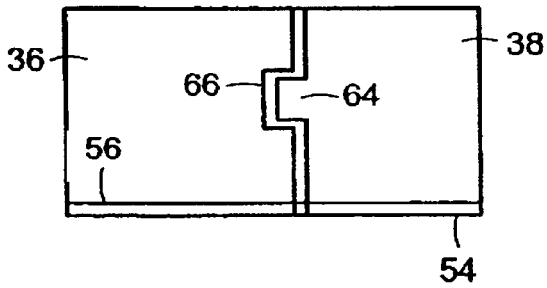
FIG. 6 is an end view of the faucet clamp of FIG. 4.

FIGS. 4, 5, and 6 show a first exemplary embodiment of a faucet clamp 34 constructed in accordance with the present invention. The faucet clamp 34 comprises a first jaw 36 and a second jaw 38. Each jaw has a hinge portion 40 and a clamping portion 42. In the illustrated example, the first and second clamping portions 42 are semi-cylindrical shapes, although the overall shape may be varied. Each jaw has a clamping surface 44 formed therein. The clamping surfaces 44 shown are cylindrical, which provides the maximum surface area contact with the faucet pipes 22, although the shape is not critical and other shapes could be used, for example the clamping surfaces 44 could be polygonal. The jaws are pivotally connected together, for example by a hinge pin 46 passing through holes in the hinge portions 40, so that the jaws may alternately be placed in an open position or a closed position. In the open position, there is an opening between the clamping portions 42 so that the faucet clamp 34 can be passed over a faucet pipe 22. In the closed position, the clamping portions 42 abut each other so that the clamping surfaces 44 form a continuous thread-engaging surface that defines a passage through the faucet clamp 34. The faucet clamp 34 may be made of various materials depending upon the particular application, such as metal, wood, or plastic.

A compliant liner 50 is disposed on each of the clamping surfaces 44. The term "compliant liner" refers to a material which is capable of being deformed by the external threads 52 of the faucet pipes 22. The nature of the compliant liner 50 may be such that it is merely indented by the faucet pipe threads 52 or it may be such that complimentary threads are actually formed in the compliant liner 50 by the action of the faucet pipe threads 52. The particular engagement process is not important. What is important is that the engagement of the threads 52 and the compliant liner 50 prevents relative motion of the faucet pipe 22 and the faucet clamp 34 along the length of the faucet pipe 22. For example, if the faucet pipes 22 are made of metal, then the compliant liner 50 could be made of deformable plastic, or if the faucet pipes are made of plastic, the compliant liner could be made of relatively softer plastic. A material such as closed-cell foam may also be used to form the compliant liner 50. The compliant liner 50 may be secured to the clamping surfaces 44 by any known method, for example by thermal bonding or by using an adhesive.

It is also possible that internal threads (not shown) formed into the clamping surfaces 44 could be used as a substitute for the compliant lining 50. The use of threads provides a more positive screw engagement and feeding action, whereas a compliant liner 50 makes installation of the faucet clamp 34 easier because no thread alignment is required.

Padding 54 is disposed on a top surface 56 of the faucet clamps 34. The padding 54 may comprise closed-cell foam or a similar material and may be split into two or more pieces to conform to the shapes of the jaws. The padding 54 may also be formed integrally with the compliant liner 50.

Means for deforming the compliant liner are provided. For example, a torsion spring 58 (see FIG. 4) is captured around the hinge pin 46. The torsion spring 58 has legs 60 that bear against the jaws and biases the jaws towards the closed position thereby deforming the compliant liner to form threads therein by engagement with the threaded faucet pipe. The jaws optionally include complimentary alignment features 62 such as the tongue 64 and groove 66 depicted in FIG. 6. In the closed position, the tongue 66 fits into the groove 64 to help keep the jaws 36 and 38 aligned.

Figure 8:
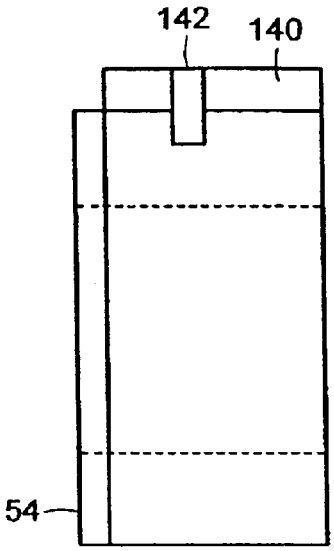
FIG. 8 is a side view of the faucet clamp of FIG. 7.
Figure 7:
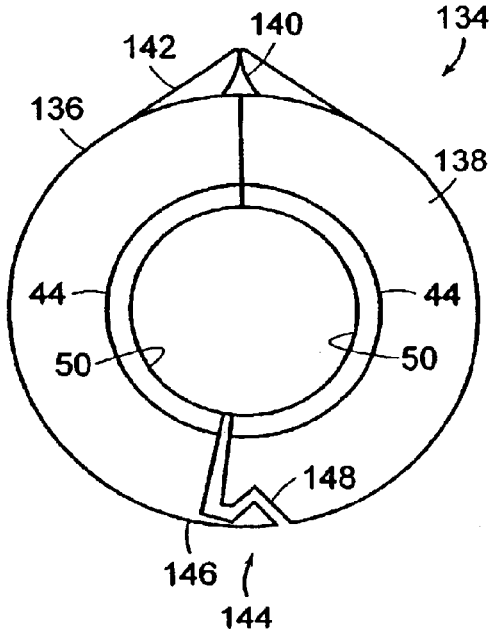
FIG. 7 is a top view of an alternate embodiment of a faucet clamp constructed in accordance with the present invention.
Figure 9:
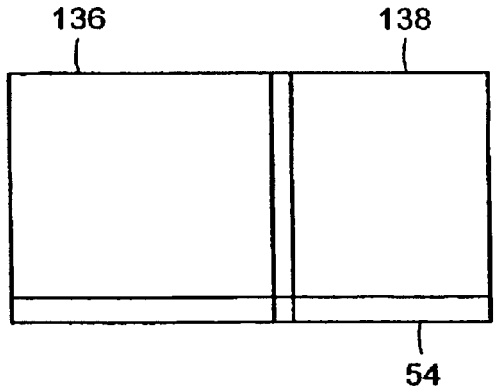
FIG. 9 is an end view of the faucet clamp of FIG. 7.

FIGS. 7, 8, and 9 show an alternate embodiment of a faucet clamp 134 constructed in accordance with the present invention. Like the first embodiment described above, the faucet clamp 134 comprises a first jaw 136 and a second jaw 138 which are pivotally connected together. In the illustrated example, the first and second jaws 136 and 138 are made of plastic and are hinged together by an integral plastic spine-type hinge 140 in a known manner. A leaf spring 142 is attached to the jaws (for example with an adhesive) and biases the jaws towards the open position. The particular example shown also includes a means for deforming the compliant liner to form threads therein. More specifically, latch 144 which holds the faucet clamp 34 in the closed position. The latch 144 is integrally formed with the jaws and comprises a flexible tang 146 that engages a complimentary notch 148. This alternative embodiment does not include handles 150 as shown in FIG. 4. When operating in an environment in which handles 150 would hinder rotation of the faucet clamp about faucet pipes 22 (for example, in an effort to tighten the faucet clamp against sink flange 16), this alternative embodiment would be particularly useful.

In use, one of the faucet clamps is substituted for each of the retainer nuts 26 described above. To install the faucet 20, the faucet pipes 22 are taped and then the fill pipes 28 are connected to the faucet pipes 22 with threaded fittings 30. All of these steps may take place while the sink and faucet 20 (or at least the faucet 20 in the case of an integral sink) are out in the open and easily accessible. Next, the faucet 20 with the fill pipes 28 attached is installed into the faucet mounting holes 18 in the sink 10.

The faucet clamps are then attached to the fill pipes 28. To do so, the faucet clamps are put in an open position and then slipped over the faucet pipes 22. As shown clearly in FIG. 4, handles 150 may be used to open jaws 36 and 38 enabling engagement of faucet pipes 22. The faucet clamps are then closed around the faucet pipes. As the jaws are closed, the compliant liners (or the threads formed in the clamping surfaces) engage the threads 52 of the faucet pipes 22, which prevents the faucet clamps from moving longitudinally with respect to the faucet pipes 22 and holds the faucet 20 against the underside of the sink flange 16. Normally, the faucet clamps would be pressed firmly against the underside of the sink flange 16 and the faucet 20 would be pulled down tight before closing the faucet clamps. If necessary after closing, the faucet clamps may be screwed onto the threads 52 of the faucet pipes 22 to clamp the faucet 20 more tightly against the sink flange 16. The padding 54 contacts the underside of the sink flange 16 and friction between the padding 54 and the sink flange 16 prevents the faucet clamp 34 from unthreading. After the faucet clamps are tightened, the free ends of the fill pipes 28 may be connected to fill valves 32 which control the flow of hot and cold water.

To remove the faucet 20, the fill pipes 28 are disconnected from the fill valves 32 and the faucet clamps are disengaged from the faucet pipes 22. This may be done by squeezing handles 150 provided on the faucet clamps, or by prying the pivotally connected clamp jaws apart with an appropriate tool. In either case, once the jaws are open the faucet clamp may be simply slid off of the faucet pipes 22, freeing the faucet 20 to be removed from the sink 10 once the fill pipes 28 are disconnected from the fill valves 32. The removal process is significantly easier than with prior art faucet retainers, because the opening of the faucet clamp is not affected by corrosion or hard water deposits on the faucet pipes 22.

While specific embodiments of the present invention have been described, it will be apparent to those skilled in the art that various modifications thereto can be made without departing from the spirit and scope of the invention as defined in the appended claims.

What is claimed is:

1. A faucet clamp, comprising:

first and second pivotally connected jaws defining clamping surfaces, and a thread-engaging surface disposed on each of said clamping surfaces, said thread-engaging surface comprising a compliant liner formed of a separate and softer material than said jaws and a means for deforming the compliant liner to form threads therein by engagement with the threaded faucet pipe such that the clamp can be pressed firmly against an underside of a sink flange without rotational movement of the faucet clamp relative to the threaded faucet pipe.

2. The faucet clamp of claim 1 wherein said compliant liner comprises a layer of foam material.

3. The faucet clamp of claim 1 wherein said compliant liner comprises deformable plastic.

4. The faucet clamp of claim 1 further comprises a spring which biases said jaws towards said open position.

5. The faucet clamp of claim 4 wherein the means for deforming the compliant liner comprises a latch which secures said jaws in said closed position.

6. A faucet clamp for securing a faucet to a sink, comprising:

a first Jaw defining a first semi-cylindrical damping surface for engaging an externally threaded faucet pipe, wherein a first compliant liner for engaging the threads of said faucet pipe is disposed on said first clamping surface, wherein the first compliant liner is formed of a separate and softer material than said jaws and a means for deforming the compliant liner to form threads therein by engagement with the threaded faucet pipe such that the clamp can be pressed firmly against an underside of a sink flange without rotational movement of the faucet clamp relative to the threaded faucet pipe;

a second jaw defining a second semi-cylindrical clamping surface, wherein a second compliant liner for engaging the threads of said faucet pipe is disposed on said second clamping surface, wherein the second compliant liner is formed of a separate and softer material than said jaws and a means for deforming the compliant liner to form threads therein by engagement with the threaded faucet pipe such that the clamp can be pressed firmly against an underside of a sink flange without rotational movement of the faucet clamp relative to the threaded faucet pipe; and a hinge connecting said first and second jaws such that said jaws may pivot between an open position wherein a space exists between said jaws, and a closed position wherein said first and second jaws abut each other so that said first and second compliant liners cooperate to define a substantially continuous, generally cylindrical thread-engaging surface.

7. The faucet clamp of claim 6 wherein said compliant liner comprises a layer of foam material.

8. The faucet clamp of claim 6 wherein said compliant liner comprises deformable plastic.

9. The faucet clamp of claim 6 wherein each of said jaws includes a handle extending therefrom.

10. The faucet clamp of claim 6 further comprising a spring which biases said jaws towards said open position.

11. The faucet clamp of claim 10 further comprising a latch which secures said jaws in said closed position.

12. The faucet clamp of claim 6 wherein the means for deforming the compliant liner comprises a spring which biases said jaws towards said closed position.

13. The faucet clamp of claim 6 wherein said hinge comprises a pin extending through a hole formed in each of said jaws.

14. The faucet clamp of claim 6 wherein said hinge comprises a plastic spine hinge which is connected to each of said jaws.

15. The faucet clamp of claim 6 further comprising padding disposed on a top surface of each of said jaws.

* * * * *

UNITED STATES PATENT AND TRADEMARK OFFICE

CERTIFICATE OF CORRECTION

PATENT NO. : 6,953,314 B2
DATED : October 11, 2005
INVENTOR(S) : Timothy Magagna It is certified that error appears in the above-identified patent and that said Letters Patent is hereby corrected as shown below:

Column 5,
Line 1, change “comprises” to -- comprising --.
Line 8, change “Jaw” to -- jaw --.
Line 8, “damping” to -- clamping --.

Signed and Sealed this

Third Day of January, 2006

JON W. DUDAS
*Director of the United States Patent and Trademark Office*